US007287841B2

(12) United States Patent
Tanaka

(10) Patent No.: US 7,287,841 B2
(45) Date of Patent: Oct. 30, 2007

(54) HEAD DRIVE CONTROL DEVICE AND INKJET RECORDING DEVICE

(75) Inventor: Shinji Tanaka, Kanagawa (JP)

(73) Assignee: Ricoh Copmany, Ltd., Tokyo (JP)

( * ) Notice: Subject to any disclaimer, the term of this patent is extended or adjusted under 35 U.S.C. 154(b) by 197 days.

(21) Appl. No.: 10/522,430

(22) PCT Filed: Sep. 17, 2003

(86) PCT No.: PCT/JP03/11851

§ 371 (c)(1),
(2), (4) Date: Jan. 25, 2005

(87) PCT Pub. No.: WO2004/026582

PCT Pub. Date: Apr. 1, 2004

(65) Prior Publication Data

US 2006/0164495 A1 Jul. 27, 2006

(30) Foreign Application Priority Data

Sep. 19, 2002 (JP) ..... 2002-272383

(51) Int. Cl.
*B41J 2/045* (2006.01)

(52) U.S. Cl. ..... 347/70; 347/68; 347/69; 347/72

(58) Field of Classification Search ..... 347/68–72
See application file for complete search history.

(56) References Cited

U.S. PATENT DOCUMENTS 6,174,051 B1 1/2001 Sakaida

FOREIGN PATENT DOCUMENTS

JP 2000-203016 7/2000
JP 2001-260346 9/2001

OTHER PUBLICATIONS

Peter F. Van Kessel et al. (Aug. 1998) "A MEMS-Based Projection Display", Proceedings of the IEEE, vol. 86, No. 8, pp. 1687-1704.

*Primary Examiner*—Stephen Meier
*Assistant Examiner*—Ly T. Tran
(74) *Attorney, Agent, or Firm*—Cooper & Dunham, LLP

(57) ABSTRACT

In an electrostatic head, each of electrostatic actuators includes a diaphragm doubling as or including a first electrode forming a wall surface of a discharge room communicating with a nozzle discharging a drop, and a second electrode opposing the first electrode. The diaphragm is deformed by generating an electrostatic force between the first electrode and the second electrode. The first electrodes or the second electrodes of the electrostatic actuators are combined electrically. Differently polarized potentials are applied to the first electrode and the second electrode upon discharging the drop.

10 Claims, 10 Drawing Sheets

HEAD DRIVE CONTROL DEVICE AND INKJET RECORDING DEVICE

TECHNICAL FIELD

The present invention generally relates to a head drive control device and an inkjet recording device, and more particularly, to a head drive control device included in an inkjet recording device which records an image by discharging ink drops.

BACKGROUND ART

As an inkjet head forming a recording head of an inkjet recording device used as an image recording device or an image forming device, such as a printer, a facsimile, and a copying machine, a head using an electrostatic actuator as disclosed in Japanese Laid-Open Patent Application No. 2001-260346 is well known.

This electrostatic inkjet head includes electrostatic actuators in each of which a diaphragm used also as or including a first electrode forming a wall surface of a discharge room communicating with a nozzle and a second electrode (an individual electrode) are opposed to each other with a predetermined air gap therebetween. A driving waveform is applied between the first electrode and the second electrode of this electrostatic actuator so as to deform the diaphragm of each actuator by utilizing an electrostatic attraction. By a mechanical force upon the deformation, or by a mechanical restitution produced in the diaphragm upon turning off the electrostatic attraction, an ink in the discharge room is discharged from the nozzle.

In a drive control device for a head using such electrostatic actuators, first electrodes of the electrostatic actuators are combined electrically to form a common electrode, and the first electrodes forming the common electrode are set to 0V, and upon discharging an ink drop, a pulse-form potential of +V is selectively applied to individual electrodes (second electrodes).

Besides, as a drive control device for driving an electrostatic actuator, PROCEEDINGS OF THE IEEE, VOL. 86, NO. 8, AUGUST 1998 "A MEMS-Based Projection Display" describes an example in which a nonzero potential is applied to both electrodes composing an actuator of an optical mirror. This drive control device applies a bias potential to a reflector plate, and applies an address potential to an electrode determining a direction of the reflector plate. Upon each control, a potential of 24V to −26V is applied to the reflector plate, and a potential of 0V or 5V is applied to the address electrode. This manner of applying the voltages is devised for maximizing a function of the optical mirror, thereby enabling the reflector plate to surely swing at +10 degrees or −10 degrees according to a control signal, with a remarkably high reliability.

By the way, an inkjet recording device, such as an inkjet printer, is required to have a high total performance, such as an output speed (a recording speed) and an image quality. To fulfill these requirements, a degree of nozzle concentration at a head is raised so as to increase a number of nozzles.

At this point, in view of a relation between an improvement of the degree of nozzle concentration and a head structure, generally, unlike a thermal head discharging an ink from a nozzle by using a pressure of cavities generated by causing the ink to undergo a film boiling by using a heating resistor, a piezoelectric or electrostatic head which includes a diaphragm having a low rigidity, and discharges an ink by varying this diaphragm, has a difficulty in raising the degree of concentration.

In order to raise the degree of concentration in an electrostatic head, a shorter-side width (a width in a direction in which nozzles are arranged) of a diaphragm has to be shortened, whereas a volume of discharged an ink drop has to be secured to a certain degree. Therefore, in order to shorten the shorter-side width of the diaphragm, a displacement of the diaphragm needs to be enlarged. In this case, from a simple viewpoint, thinning a thickness of the diaphragm can enlarge the displacement even though the shorter-side width is short; however, from a viewpoint of discharging a drop, the diaphragm needs to have a certain degree of rigidity, thereby limiting a range in which the diaphragm can be thinned.

That is, an electrostatic attraction generated in an electrostatic actuator can be represented by the following expression (1), where V is a driving voltage, g is a gap length (a distance between an individual electrode and a common electrode), and δ is a displacement of a diaphragm.

$$F=(\epsilon 0/2)\cdot V^2/(g-\delta)^2 \qquad \text{<Expression 1>}$$

As mentioned above, when the degree of nozzle concentration is raised, the gap length g should be increased. According to the expression (1), when the gap length g becomes large, the driving voltage V also needs to be raised in order to obtain the electrostatic attraction of the same magnitude. Further, as the gap length g becomes larger, the diaphragm displacement δ has a smaller variation range in relation to a variation range of the driving voltage V; therefore, even an slight enlargement of the gap length g calls for a large increase in the driving voltage V. In other words, when the degree of concentration is raised while maintaining a capability of discharging drops, the driving voltage of an actuator tends to be made higher.

Such an increase in the driving voltage means not only an increase in power consumption but also an increase in a withstand pressure of a transistor composing a drive control device (a driver) controlling the actuator. In general, as a size of a transistor becomes larger, a withstand pressure of the transistor becomes higher, although depending also on a thickness of an oxide film of the transistor. Besides, as the withstand pressure becomes higher, a manufacturing process also becomes more costly. As a result, the increase in the driving voltage leads to the cost of the drive control device becoming higher. In this case, since an inkjet head includes many actuators, the increase in the cost of the head drive control device becomes large.

Besides, an actuator in a drop discharge head needs to have a function of bending a diaphragm toward electrodes by turning a voltage on between the electrodes, and a function of returning the diaphragm to the original position by turning the voltage off. Therefore, from a functional viewpoint, there is no need for using a bias method as used in the driving method described in PROCEEDINGS OF THE IEEE, VOL. 86, NO. 8, AUGUST 1998 "A MEMS-Based Projection Display" as above; instead, applying a required potential to one electrode and setting another electrode to GND may be sufficient. Yet, when using the bias method, the voltage does not need to be changed positive and negative upon each control (for discharging one drop); rather, this impairs functions of the head. Besides, it is not necessary to apply an especially large potential to one of electrodes. Therefore, the driving method described in PROCEEDINGS OF THE IEEE, VOL. 86, NO. 8, AUGUST 1998 "A MEMS-Based Projection Display" cannot be simply applied to a drive control device for a head.

DISCLOSURE OF INVENTION

It is a general object of the present invention to provide an improved and useful head drive control device and an inkjet recording device, in which the above-mentioned problems are eliminated.

A more specific object of the present invention is to provide a head drive control device capable of driving a drop discharge head having a high degree of nozzle concentration at a low cost, and an inkjet recording device including the head drive control device.

In order to achieve the above-mentioned objects, there is provided according to one aspect of the present invention a head drive control device for driving a head in which first electrodes or second electrodes of a plurality of electrostatic actuators are combined electrically, the head drive control device including a part applying differently polarized potentials to the first electrode and the second electrode upon discharging a drop.

According to the present invention, the head drive control device can drive an inkjet head having a high degree of nozzle concentration at a low cost.

Other objects, features and advantages of the present invention will become more apparent from the following detailed description when read in conjunction with the accompanying drawings.

BEST MODE FOR CARRYING OUT THE INVENTION

A description will now be given, with reference to the drawings, of embodiments according to the present invention.

Figure 1:
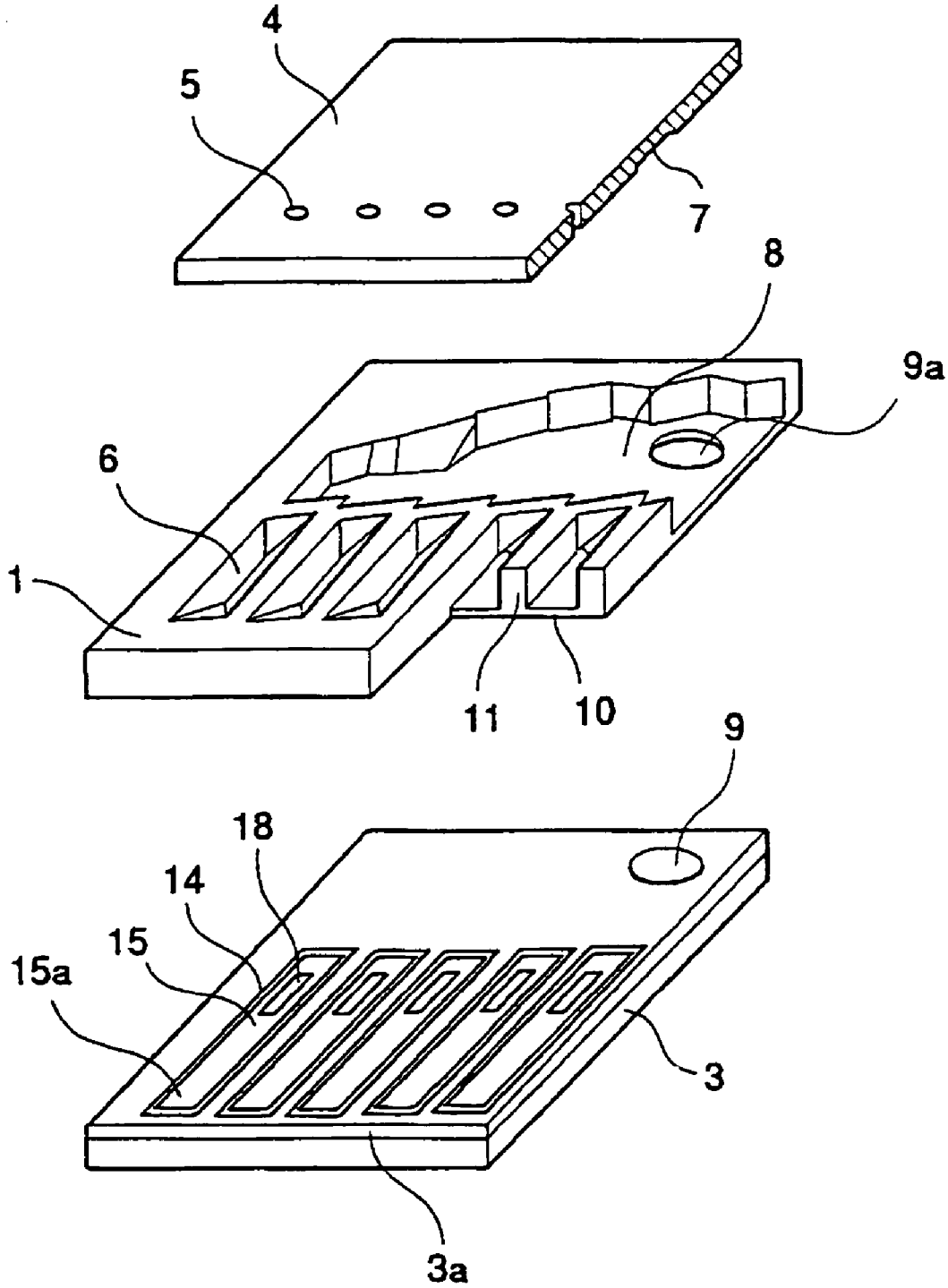
FIG. 1 is an exploded perspective view of an example of an inkjet head driven and controlled by a head drive control device according to the present invention.
Figure 2:
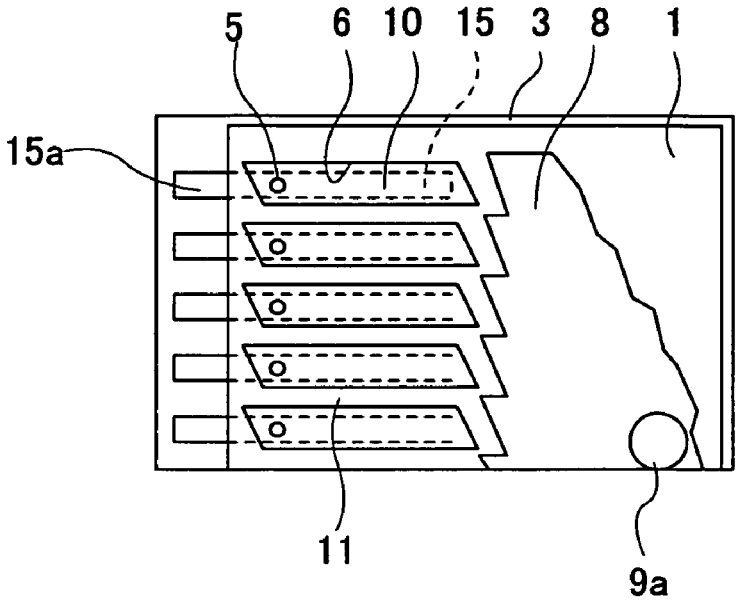
FIG. 2 is a plan view of transparently showing a nozzle board of the head shown in FIG. 1.
Figure 3:
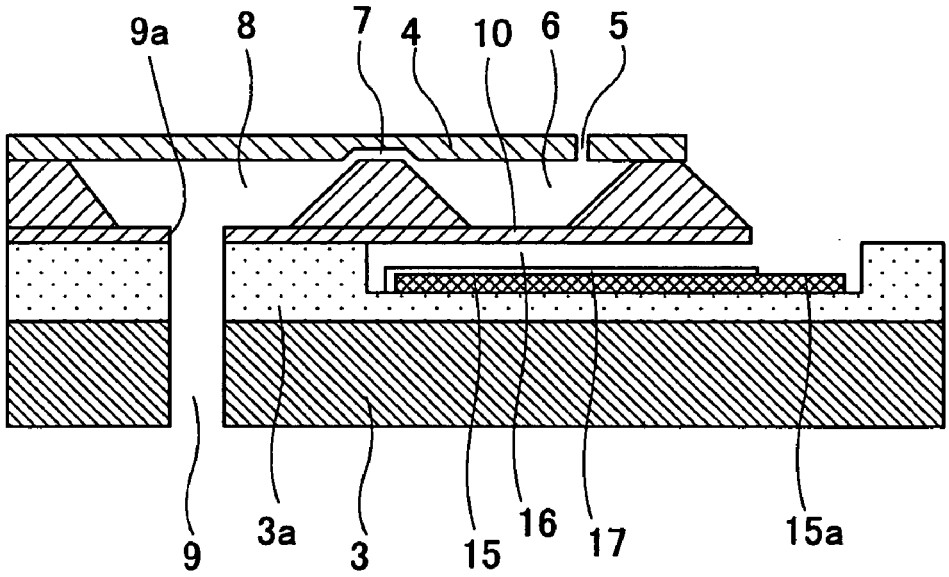
FIG. 3 is an illustrative sectional view of the head, taken along a longer-side direction of a diaphragm.
Figure 4:
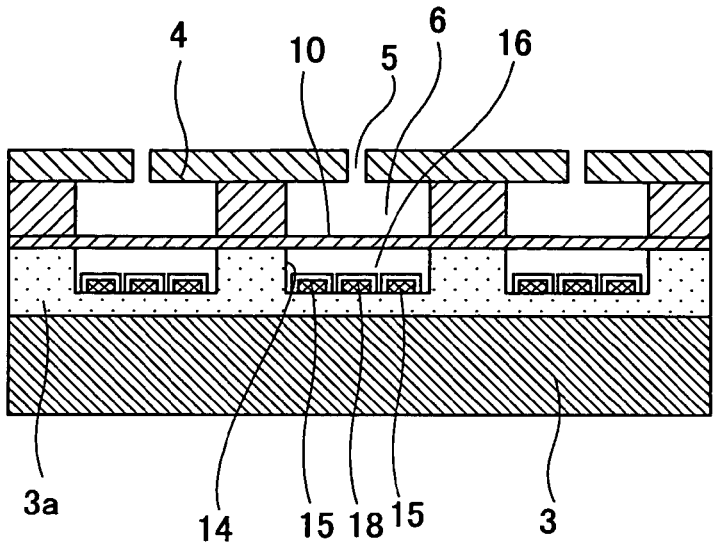
FIG. 4 is an illustrative sectional view of the head, taken along a shorter-side direction of the diaphragm.

First, a description will be given, with reference to FIG. 1 to FIG. 5, of an example of an inkjet head as a drop discharge head driven by a head drive control device according to the present invention. FIG. 1 is an exploded perspective view of the head. FIG. 2 is a plan view of transparently showing a nozzle board of the head. FIG. 3 is an illustrative sectional view of the head, taken along a longer-side direction of a diaphragm. FIG. 4 is an illustrative sectional view of the head, taken along a shorter-side direction of the diaphragm.

This inkjet head has a laminated structure in which a channel substrate 1 as a first substrate, an electrode substrate 3 as a second substrate provided under the channel substrate 1, and a nozzle board 4 as a third substrate provided over the channel substrate 1 are joined one over another, thereby forming discharge rooms 6 communicating with a plurality of nozzles 5, and a common liquid room 8 communicating with the discharge rooms 6 via a fluid resistance part 7.

In the channel substrate 1 are formed the discharge rooms 6, diaphragms 10 forming wall surfaces serving as bottom parts of the discharge rooms 6, protruding parts forming partitions 11 separating the discharge rooms 6, a receding part forming the common liquid room 8, and so forth. The common liquid room 8 is formed so that a capacity thereof becomes 20 times as much as or less than a capacity of each of the discharge rooms 6.

In the channel substrate 1, the diaphragms 10 having a desired thickness are formed as follows: a boron which is a highly concentrated impurity is diffused on a single-crystal silicon substrate (silicon wafer) of a (110) plane direction into a thickness (depth) corresponding to the diaphragms; this highly concentrated boron doped layer is used as an etching stop layer in performing an anisotropic etching to form receding parts becoming the discharge rooms 6 and so forth, thereby leaving the diaphragms 10 having the desired thickness. Besides, other than the boron, a gallium, an aluminum and so forth can be used as the highly concentrated P-type impurity.

Besides, the diaphragms 10 may be formed by a method of forming an N-type layer becoming the diaphragms on a P-type substrate, or forming a P-type layer becoming the diaphragms on an N-type substrate, and stopping an etching according to an electrochemical etching, by a method of using an SOI substrate and stopping an etching by an oxide film layer, or by a method of controlling a time to terminate an etching.

In the electrode substrate 3, receding parts 14 are formed, and electrodes 15 opposing the diaphragms 10 with a predetermined gap 16 therebetween are formed on respective bottom surfaces of the receding parts 14. The electrodes 15 and the diaphragms 10 compose actuator parts deforming the diaphragms 10 by an electrostatic force to vary the internal capacity of the discharge rooms 6. Joining the electrode substrate 3 to the channel substrate 1 forms the gap 16, and disposes the electrodes 15 at respective positions corresponding to the diaphragms 10.

For the purpose of preventing the electrodes 15 of the electrode substrate 3 from being damaged by contacting the diaphragms 10, an insulating layer 17, such as $SiO_2$ in 0.1 μm thickness, is formed on each of the electrodes 15. In addition, an electrode pad part 15*a* used for connecting to an external drive circuit via a connection part is formed by extending the electrode 15 to near an end of the electrode substrate 3.

Besides, an opposing contact part 18 contacting the diaphragm 10 being deformed is formed between the electrodes 15 in a substantially central part in the shorter-side direction of the diaphragm. The opposing contact part 18 is formed on the bottom surface of the receding part 14 in a same process with the electrodes 15. The insulating layer 17 is formed also on a surface of the opposing contact part 18. The opposing contact part 18 and the diaphragm 10 are electrically connected so as to assume an identical potential when the opposing contact part 18 and the diaphragm 10 contact each other. This prevents an occurrence of a residual electric charge upon the contact of the diaphragm 10, as described in Japanese Laid-Open Patent Application No. 2001-260346.

Besides, in the electrode substrate 3 is formed an ink supply opening 9 which is a through hole used for supplying an ink to the common liquid room 8 from outside. A through hole 9*a* is formed in the common liquid room 8 of the channel substrate 1 at a part corresponding to the ink supply opening 9.

The electrode substrate 3 is formed as follows: the receding parts 14 are formed by etching using an HF solution, etc., in a glass substrate or a single-crystal silicon substrate including a thermally-oxidized film 3*a* formed on a surface thereof; an electrode material, such as a titanium nitride, having a high heat resistance is formed into a film having a desired thickness in the receding part 14 by a film-forming technique, such as a sputtering, a CVD, or a deposition; thereafter, the electrodes 15 are formed only in the receding part 14 by forming a photoresist and etching the film. The electrode substrate 3 and the channel substrate 1 are joined to each other by a process, such as an anodic junction or a direct junction.

In the present embodiment, the electrodes 15 and the opposing contact part 18 are formed by sputtering the titanium nitride into a thickness of 0.1 μm in the receding part 14 having a depth of 0.4 μm formed by etching the silicon substrate; thereon, an $SiO_2$ sputtering film is formed as the insulating layer 17 in a thickness of 0.1 μm. Accordingly, in the present head, the air gap 16 has a length (an interval between the diaphragm 10 and a surface of the insulating layer 17) of 0.2 μm after joining the electrode substrate 3 and the channel substrate 1.

In the nozzle board 4, the nozzles 5 and a groove forming the fluid resistance part 7 are formed, and a water-repellent finishing is applied to a discharge surface. The nozzle board 4 is formed of a resin material, such as a polyimide, and is joined to the channel substrate 1 with an adhesive. The nozzle board 4 forms a wall surface of the common liquid room 8.

In the present head, the diaphragm 10 is connected to a common electrode, and the electrode pad 15*a* is bonded with a lead, and is connected with a driver not shown in the figures, thereby enabling the inkjet head to be driven.

Besides, an ink supply pipe may be joined to the ink supply opening 9, thereby enabling the common liquid room 8 and the discharge rooms 6 and so forth to be filled with an ink supplied from an ink tank (not shown in the figures) via the ink supply opening 9. The ink used is prepared by dissolving or diffusing a surface-active agent, such as an ethylene glycol, and a dye or a pigment, in a main solvent, such as water, alcohol or toluene. Further, attaching a heater to the inkjet head enables a use of a hot-melt ink.

With the above-described structure, when a positive voltage pulse, for example, is impressed to the electrode 15 by the driver so that a surface of the electrode 15 is charged at a positive potential, an undersurface of the corresponding diaphragm 10 is charged at a negative potential. Accordingly, the diaphragm 10 is attracted by an electrostatic force so as to bend toward a direction narrowing an interval with the individual electrode 15. In this course, the bending of the diaphragm 10 causes the ink to be supplied from the common liquid room 8 via the fluid resistance part 7 to the discharge room 6.

Subsequently, when the voltage pulse impressed to the electrode 15 is turned off so as to discharge a stored electric charge, the diaphragm 10 is restored to the original position. This restoration action causes an internal pressure of the discharge room 6 to rise sharply so that an ink drop is discharged from the nozzle 5 toward a recording sheet (not shown in the figures).

Next, a description will be given of the head drive control device according to the present invention for driving the head using the above-described electrostatic actuators.

First, a description will be given of a reason why a driving method of impressing differently polarized potentials to first and second electrodes is possible as in the head drive control device according to the present invention. In the above-described inkjet head, the diaphragms forming the first electrodes are unitary throughout the actuators; therefore, the first electrodes of the actuators are combined electrically. Generally, electrodes electrically combined among the actuators are referred to as common electrode, electrodes not combined electrically among the actuators are referred to as individual electrodes, and a voltage impressed to the common electrode is referred to as "bias voltage".

For simplicity's sake, it is assumed that a diaphragm fixed at four sides receives a uniform load by an electrostatic attraction. On this assumption, a bending amount δ of the diaphragm is represented by the following expression (2), where E is a Young's modulus of a material of the diaphragm, h is a thickness of the diaphragm, ν is a Poisson's ratio of the material of the diaphragm, a is a shorter-side width of the diaphragm, and δ is the bending amount of the diaphragm.

$$F=(32\cdot E\cdot h3/(1-\nu 2)/a^4)\cdot\delta \qquad \text{<Expression 2>}$$

Figure 5:
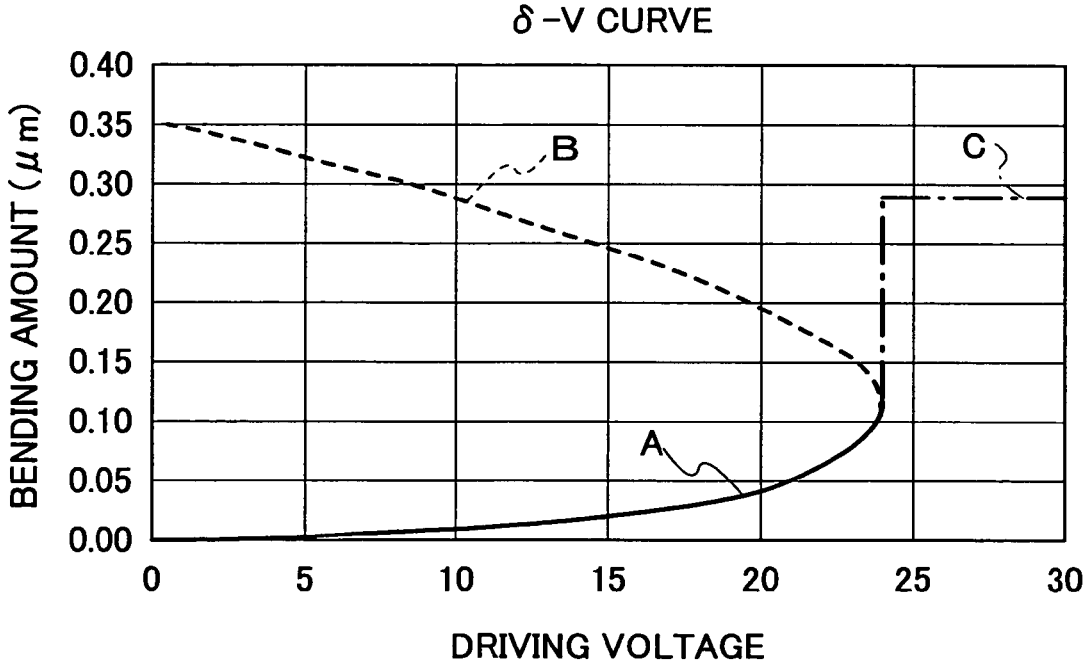
FIG. 5 is a graph representing a relation between a bending amount of a first electrode (the diaphragm) and a driving voltage in an electrostatic actuator.

Ignoring effects of gases existing between both electrodes, and substituting specific values shown in Table 1 for the values in the above-mentioned expressions (1) and (2), a δ-V curve is represented in a graph as shown in FIG. 5.

TABLE 1

| Parameters used in calculation | |
|---|---|
| Distance between electrodes (excluding electrode insulating layers) (μm) | 0.3 |
| Material of electrode insulating layers | $SiO_2$ |
| Total thickness of electrode insulating layers (μm) | 0.2 |
| Young's modulus of diaphragm (GPa) | 290 |
| Poisson's ratio of diaphragm | 0.293 |

TABLE 1-continued

| Parameters used in calculation | |
|---|---|
| Shorter-side width of diaphragm (μm) | 120 |
| Thickness of diaphragm (μm) | 2 |

As shown in FIG. 5, although curves A and B are obtained theoretically, the curve B does not stand in actuality; instead, characteristics of a curve C are realized with respect to bending amounts in a domain of the curve B.

As shown in FIG. 5, a maximum bending amount (a maximum displacement) is 0.3 μm, and a maximum driving voltage is 23.6V; even when 21V, which is equivalent to 90% of the maximum driving voltage, is impressed, the bending amount is 0.06 μm equivalent to 20% of the maximum displacement. That is, when a drop is discharged from a nozzle by driving one actuator while impressing a bias voltage of 21V to a common electrode, the bias voltage of 21V is impressed also to other actuators not discharging drops; however, there occurs no trouble, such as drops discharged by this bias voltage, because the bending amount is only 0.06 μm equivalent to 20% of the maximum displacement.

In reality, because of gases existing between both electrodes, the δ-V curve is not represented in the graph as shown in FIG. 5; however, the qualitatively same thing can be applied.

Figure 6A:
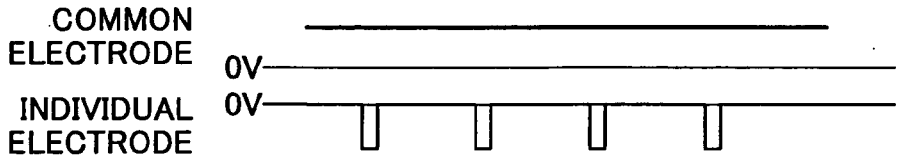
FIG. 6A to FIG. 6E are waveform diagrams showing various examples of driving waveforms applied by the head drive control device according to the present invention to a common electrode and individual electrodes of the electrostatic actuator.
Figure 6B:
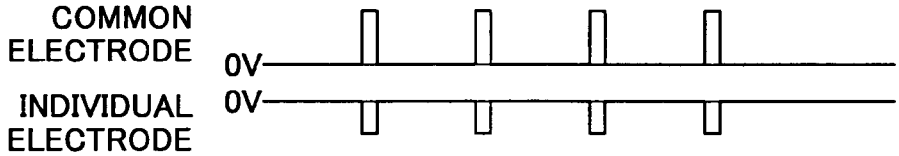
Figure 6C:
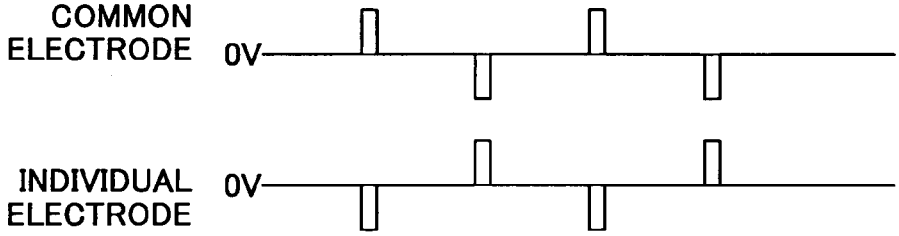
Figure 6D:
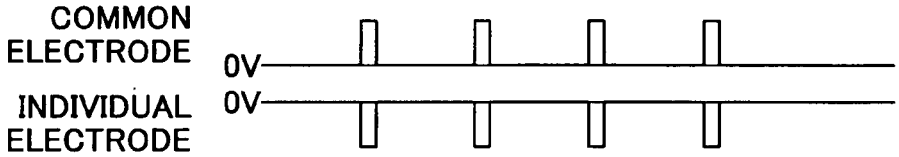
Figure 6E:
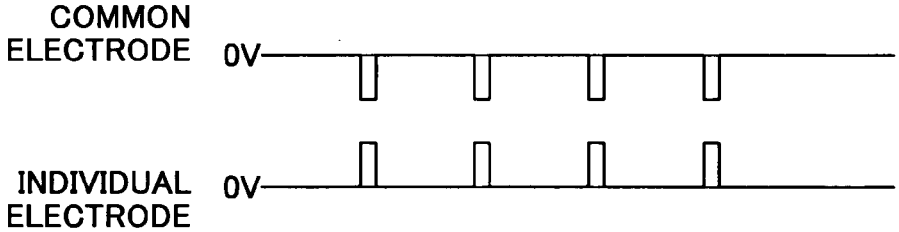
Figure 6F:
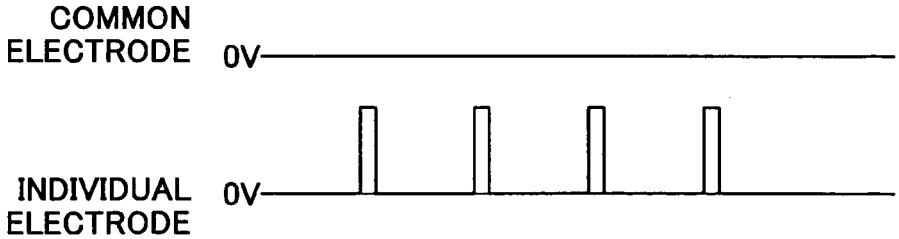
FIG. 6F is a waveform diagram showing conventional driving waveforms applied to a common electrode and individual electrodes of an electrostatic actuator.

By a conventional head drive control device, a common electrode is set to GND, and upon discharging a drop, a + potential is applied to individual electrodes, as shown in FIG. 6F.

By contrast, by the head drive control device according to the present invention, differently polarized potentials are applied to a common electrode and individual electrodes upon discharging a drop, as shown in FIG. 6A to FIG. 6E.

Specifically, in a first example shown in FIG. 6A, a + potential (a + bias voltage) is applied to the common electrode, and a − potential is applied to the individual electrodes in a pulse waveform upon discharging. In a second example shown in FIG. 6B, a + potential is applied to the common electrode in a pulse waveform upon discharging, and a − potential is applied to the individual electrodes in a pulse waveform at substantially the same time. In a third example shown in FIG. 6C, potentials applied to the common electrode and the individual electrodes have pulse waveforms alternately reversing polarities; upon discharging, a + potential is applied to the common electrode, and a − potential is applied to the individual electrodes; upon next discharging, a − potential is applied to the common electrode, and a + potential is applied to the individual electrodes.

In a fourth example shown in FIG. 6D, a + potential is applied to the common electrode in a pulse waveform upon discharging, and a − potential is applied to the individual electrodes in a pulse waveform at substantially the same time, wherein the potentials applied to the common electrode and the individual electrodes have absolute values of maximum values set substantially equal. Similarly, in a fifth example shown in FIG. 6E, a − potential is applied to the common electrode in a pulse waveform upon discharging, and a + potential is applied to the individual electrodes in a pulse waveform at substantially the same time, wherein the potentials applied to the common electrode and the individual electrodes have absolute values of maximum values set substantially equal.

Accordingly, providing the head drive device with a part for generating the driving waveforms shown in FIG. 6A to FIG. 6E enables differently polarized potentials to be applied to the common electrode and the individual electrodes upon discharging.

The driving waveforms shown in FIG. 6A and FIG. 6B are adoptable when the actuator has a structure in which a residual electric charge does not occur, or is removed. Specifically, as in the inkjet head described above, it is preferred that the actuator employs the structure in which the opposing contact part 18 is provided between the electrodes 15, and the opposing contact part 18 and the diaphragm 10 assume an identical potential upon the diaphragm 10 contacting the opposing contact part 18.

Figure 7:
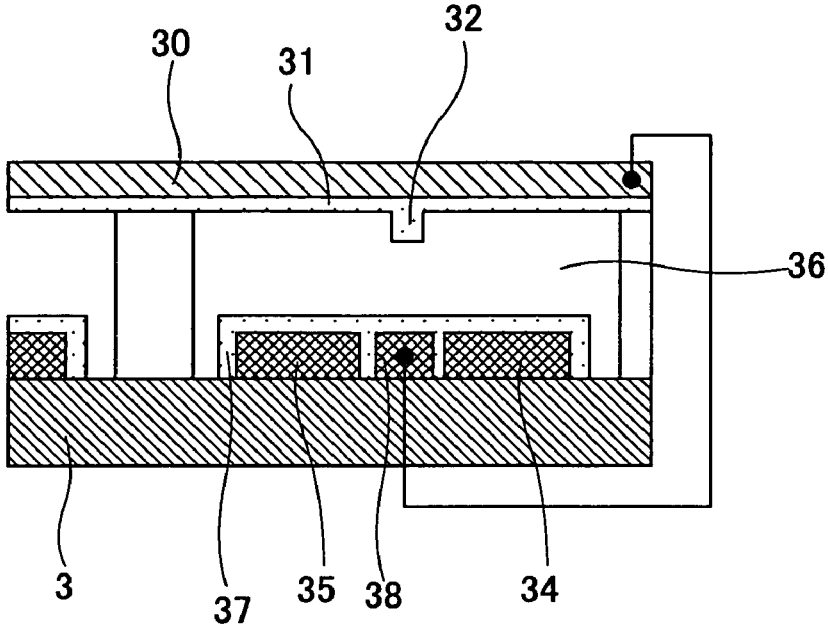
FIG. 7 is a sectional view of main parts of another example of a head preventing a residual electric charge.
Figure 8:
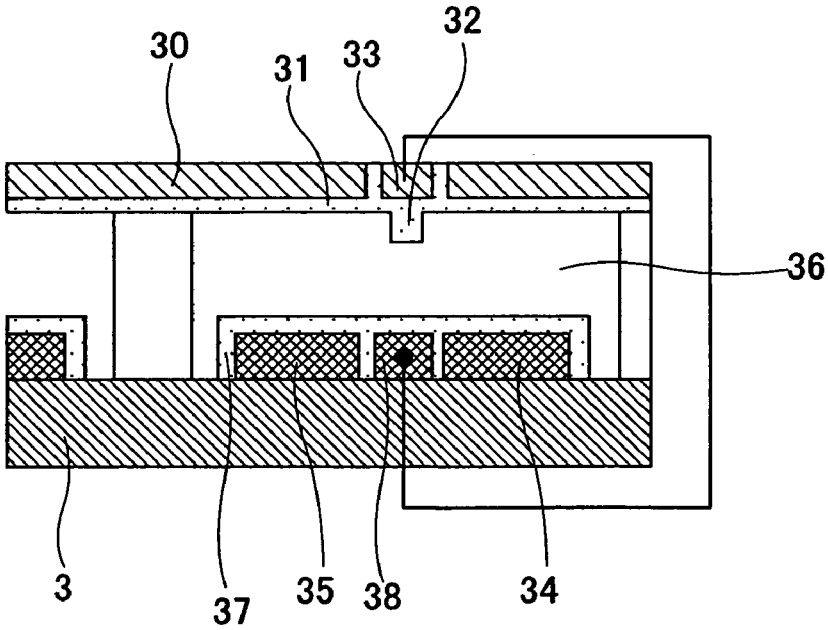
FIG. 8 is a sectional view of main parts of still another example of a head preventing a residual electric charge.

Besides, a structure preventing a residual electric charge is not limited to the structure employed in the above-mentioned inkjet head, and other structures such as shown in FIG. 7 and FIG. 8 are also adoptable. In these structures, a protruding part at which a diaphragm and an electrode can contact is provided on the diaphragm, and the diaphragm and the electrode assume an identical potential at this protruding contact part.

Specifically, in the structure shown in FIG. 7, an insulating film 31 formed on an electrode-side surface of a diaphragm 30 forms a protruding part 32 opposing electrodes. On the other hand, on the electrode substrate 3, electrodes 35 and 34 opposing the diaphragm 30 with a gap 36 therebetween are provided, and a separate electrode 38 separated from the electrodes 35 and 34 is provided. The separate electrode 38 is located at a position contacting the protruding part 32 when the diaphragm 30 deforms. Besides, an insulating film 37 is formed on surfaces of the electrodes 35 and 34 and the separate electrode 38. The separate electrode 38 and the diaphragm 30 are electrically connected.

According to this structure, upon driving the actuator, a potential applied to the diaphragm 30 is forcibly applied to the separate electrode 38.

In the structure shown in FIG. 8, the insulating film 31 formed on the electrode-side surface of the diaphragm 30 forms the protruding part 32 opposing the electrodes. Besides, a separate electrode 33 separated electrically from the diaphragm 30 by the insulating film 31 is formed at a backside of the protruding part 32. On the other hand, on the electrode substrate 3, the electrodes 35 and 34 opposing the diaphragm 30 with the gap 36 therebetween are provided, and the separate electrode 38 separated from the electrodes 35 and 34 is provided. The separate electrode 38 is located at the position contacting the protruding part 32 when the diaphragm 30 deforms. Besides, the insulating film 37 is formed on the surfaces of the electrodes 35 and 34 and the separate electrode 38. The separate electrode 38 and the separate electrode 33 are electrically connected.

According to this structure, a potential of a contact part (the separate electrodes 38 and 33) can be determined regardless of a potential applied upon driving the actuator. In this case, the potential of both electrodes 38 and 33 can be set to GND constantly.

Besides, in the structures shown in FIG. 7 and FIG. 8, the protruding part is formed by the insulating film; however, the protruding part may be formed by an electrode material.

In addition, it is preferred that the driving waveforms shown in FIG. 6C are adopted when the actuator has a structure in which an occurrence of a residual electric charge is not prevented. That is, this driving waveform applies a pulse potential having a polarity reversed from a preceding pulse to each electrode so as to neutralize the residual electric charge.

Besides, in the above-described structures, one dot in an image is formed by one drop discharged from the nozzle; however, these structures are similarly applicable when one dot in an image is formed by several drops discharged from the nozzles, i.e., when a dot is formed by discharging a plurality of ink drops in one driving cycle.

Figure 9:
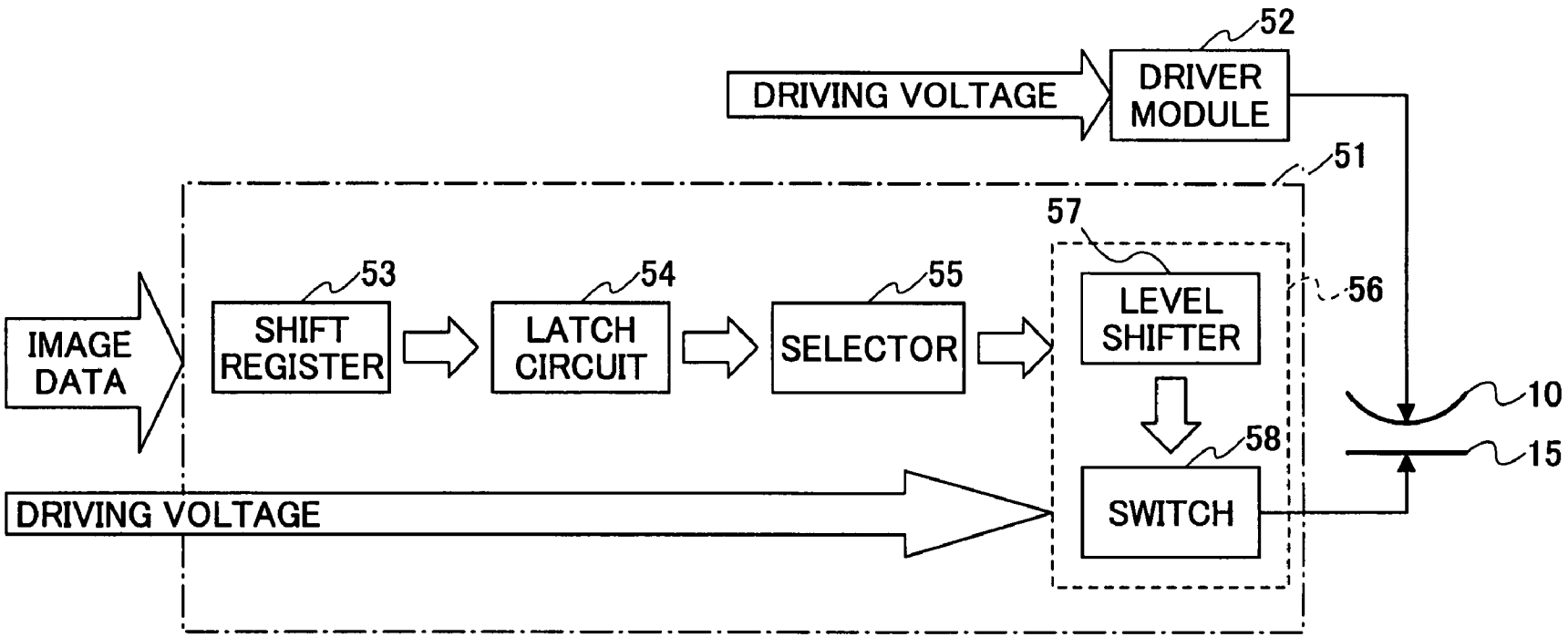
FIG. 9 is a block diagram of a structure of the head drive control device according to the present invention.

Next, a description will be given, with reference to FIG. 9, of a structure of the head drive control device according to the present invention.

The present head drive control device includes a drive control part 51 for selectively applying a driving potential to the individual electrodes 15 of a plurality of the electrostatic actuators, and a driver module 52 for applying a driving potential to the diaphragm 10 as the common electrode. Besides, at least the drive control part 51 and the driver module 52 form a part applying differently polarized potentials to the first electrode and the second electrode upon discharging a drop.

Figure 10:
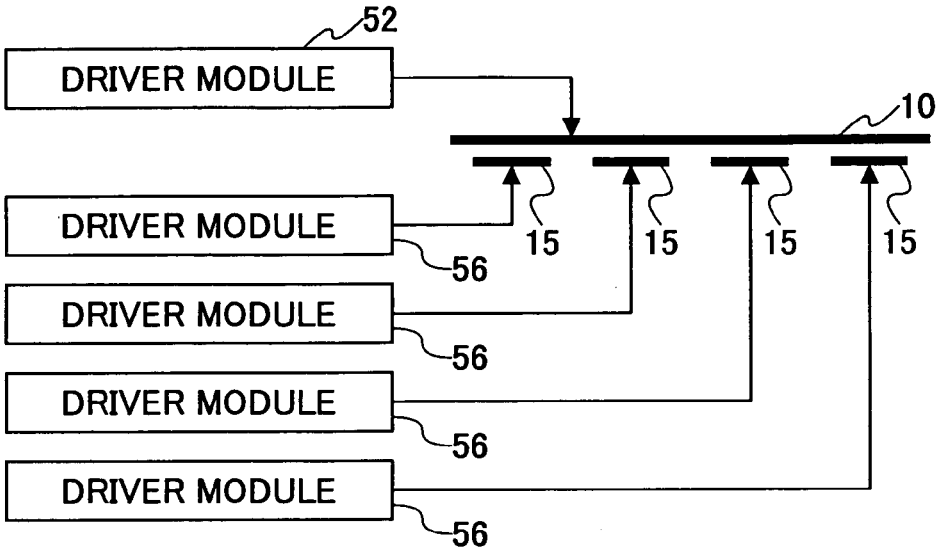
FIG. 10 is a diagram showing a relation between driver modules and actuators in the head drive control device shown in FIG. 9.

The drive control part 51 has a structure as follows, as in a general head drive control device. In this structure, image data supplied from a main control part not shown in the figures is transmitted to a shift register 53 serially in synchronization with a clock, is converted into parallel data, and is stored in a latch circuit 54 temporarily. An actuator to be driven is selected by a selector 55. A logic driving voltage of 5V is converted into a predetermined voltage capable of driving a switch 58 by a level shifter 57 in one of driver modules 56 (only one driver module 56 shown in FIG. 9) provided according to a number of the actuators as shown in FIG. 10, and is supplied to the switch (analog switch) 58. The driving voltage is supplied to the switch 58 so as to turn on the switch 58, thereby applying the driving voltage to the individual electrode 15.

On the other hand, a driving voltage is applied from the driver module 52 to the diaphragm 10 which is the common electrode.

The shift register 53, the latch circuit 54 and the selector 55 are so-called logic parts, which are driven by (0V, 5V); therefore, a constituent transistor composing these parts may only have a withstand pressure of 5V. On the other hand, a withstand pressure of the level shifter 57 and the switch 58 composing the driver module 56 depends on the driving voltage of the actuator; when the driving voltage is high, the withstand pressure of the constituent transistor has to be also high. That is, when the driving voltage of the actuator rises, a cost of the driver also rises.

Figure 11:
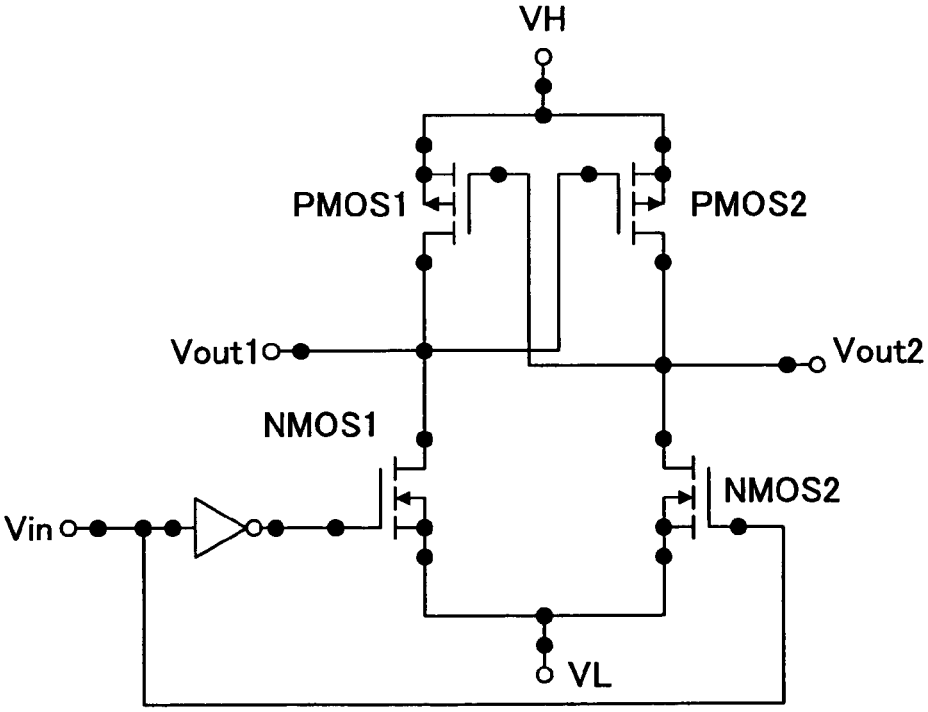
FIG. 11 is a circuit diagram of a basic circuit structure of one level shifter in the head drive control device shown in FIG. 9.
Figure 12:
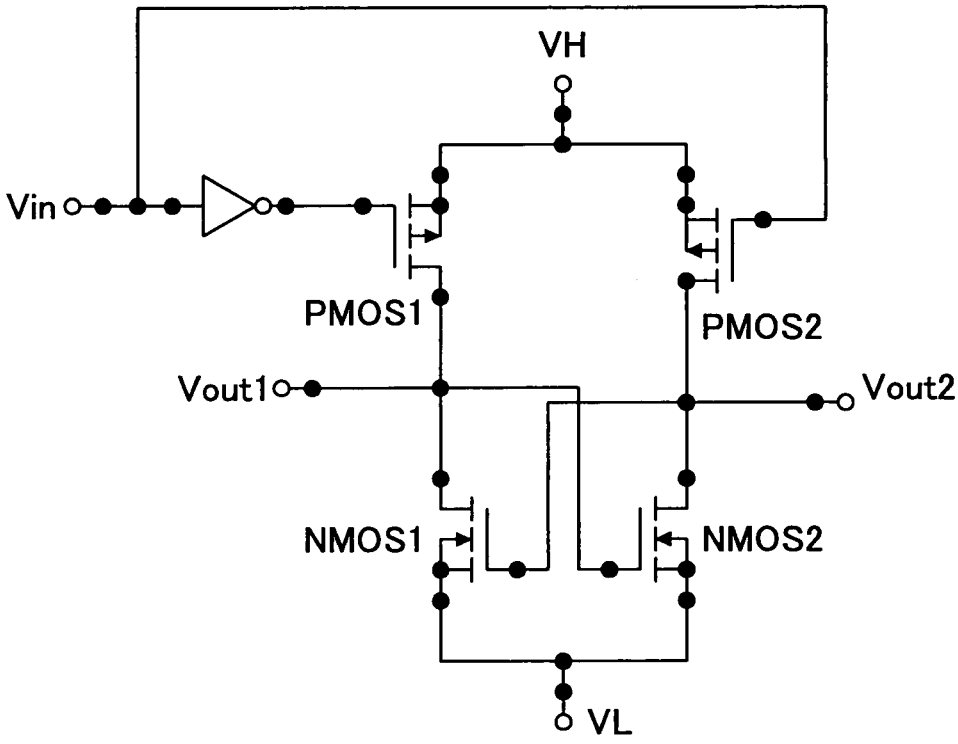
FIG. 12 is a circuit diagram of a basic circuit structure of another level shifter in the head drive control device shown in FIG. 9.
Figure 13:
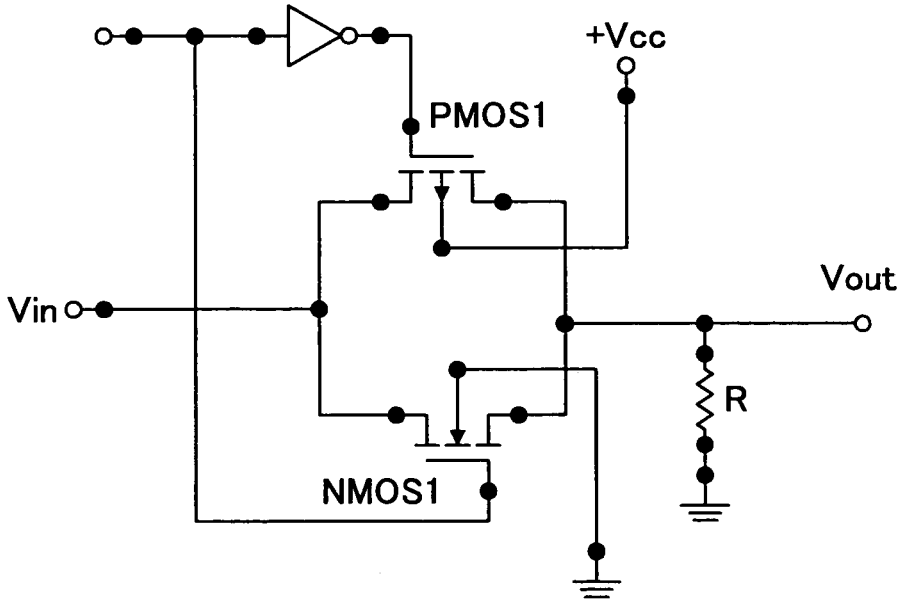
FIG. 13 is a circuit diagram of a basic circuit structure of an analog switch in the head drive control device shown in FIG. 9.

Besides, basic circuits of the level shifter 57 composing the driver module 56 are shown in FIG. 11 and FIG. 12, and a basic circuit of the switch 58 is shown in FIG. 13. Besides, the level shifter shown in FIG. 11 is a positive voltage conversion type, and the level shifter shown in FIG. 12 is a negative voltage conversion type.

As mentioned above, the withstand pressure of the level shifter 57 and the switch 58 depends on the driving voltage of the actuator. In the electrostatic head, the individual electrodes 14 exist according to the number of the actuators, and a number of the common electrode is limited to one or several. Therefore, the drive control device requires many driver modules 56 for the individual electrodes, and one or several driver modules 52 for the common electrode.

A withstand pressure required for a transistor composing each of the driver modules approximately equals a voltage used upon driving the actuator. Accordingly, when a total voltage impressed to the actuators is 80V, for example, with +30V being impressed to the common electrode and −50V being impressed to the individual electrodes, a withstand pressure of transistors composing the driver module for the common electrode is approximately 30V, and a withstand pressure of transistors composing the driver modules for the individual electrodes is approximately 50V.

In actuality, for reasons mentioned hereinafter, the withstand pressure of the transistor used for applying a negatively-polarized potential rises slightly. In a conventional drive control device, since the common electrode is set to GND, the driver module for the common electrode is not required. According to the drive control device of the present invention, even when the driving voltage of the electrostatic actuator rises, the withstand pressure of the transistors composing the driver module can be suppressed. This is more advantageous in terms of costs than increasing the number of the driver modules for the common electrode by one or several.

Further, since only the basic circuit structures are shown in FIG. 11 to FIG. 13, and compensations for changes in power supply voltage and changes in temperature and so forth are required in reality, the circuits become more complicated with a larger number of transistors. In this case, the decrease in the withstand pressure of the transistors as a result of using the head drive control device according to the present invention enables a large cost reduction of the drive control device.

Besides, in the head drive control device according to the present invention, upon discharging a drop, the change of the driving voltage of the actuator may be controlled by a magnitude of a potential impressed to the individual electrodes while a magnitude of a potential impressed to the common electrode may be fixed; this does not complicate the driver module for the common electrode, and therefore is more preferable.

Besides, in the present embodiment, the diaphragms form the common electrode; however, a manufacturing process determines which of the diaphragm and the opposing electrodes should form the common electrode; therefore, the present invention is similarly applicable when the opposing electrodes form the common electrode.

Next, a description will be given of maximum values of potentials impressed to the first and second electrodes. The potentials impressed to the first and second electrodes have substantially the same absolute value as in the fourth and fifth examples shown in FIG. 6D and FIG. 6E. That is, it is preferred that the absolute values of the maximum voltages are set substantially the same.

Besides, the above-mentioned "maximum voltage" includes a margin voltage for temperature compensation and so forth. Additionally, "substantially the same" means that withstand pressures of P-channel MOSFETs and N-channel MOSFETs composing the driver modules are substantially the same. Strictly, however, for reasons mentioned hereinafter, it is preferred that an absolute value of a maximum value of a negatively-polarized potential among the potentials impressed to the first and second electrodes is set lower than an absolute value of a maximum value of a positively-polarized potential thereamong by approximately 5V, for example, which is equivalent to a voltage used for the logic parts of the drive control device.

Accordingly, it becomes unnecessary to provide a transistor having a prominently large withstand pressure. That is, there is no element which occupies a large area by itself. Besides, making the withstand pressures substantially the same avoids complicating a manufacturing process, as a result of which a total cost of the drive control device including materials and manufactures thereof can be reduced.

Especially, as in the inkjet head, when there are hundreds of nozzles, i.e., many actuators, the reduction of the total cost exhibits a large advantage. Specifically, in the drive control device controlling a 96-bit electrostatic actuator made on an experimental basis, 96 driver modules using transistors having a large withstand pressure were required according to the conventional driving voltage impressing method (FIG. 6F). On the other hand, in the head drive control device (the example of FIG. 6D) according to the present invention, only 97 (=96+1) driver modules using transistors having half the withstand pressure were required. Thus, it was confirmed that a large cost reduction can be achieved for the drive control device as a whole.

Besides, the above-described bias driving method for the common electrode is completely different from a driving method used in a conventional optical mirror and so forth in respect of methods for impressing a voltage and effects thereof.

Next, a description will be given of waveforms of potentials impressed to the first and second electrodes. Potentials impressed to the common electrode combined electrically throughout the actuators are preferred to have pulse waveforms as shown in FIG. 6B to FIG. 6E. In this case, pulse voltages impressed to the common electrode and the individual electrodes are preferred to have substantially the same pulse width.

That is, other than the pulse voltage, a direct-current voltage (FIG. 6A) can also be impressed to the common electrode, and impressing the direct-current voltage or the pulse voltage does not result in substantially different characteristics. However, biasing with the direct-current voltage produces a merit of simplifying circuit structures.

However, in a head having a small sum of a restitution force of the diaphragm upon turning off the voltage, i.e., a restitution force due to the rigidity of the diaphragm, and a repulsive force of gases existing between electrodes after compression, the presence of the direct-current bias may inhibit the restitution of the diaphragm.

With reference to the theoretical curves A and B shown in FIG. 5 ignoring the existence of gases (air) between electrodes, on the above-mentioned assumption, in order to separate the diaphragm once contacting the electrode therefrom, the voltage impressed to the actuator theoretically needs to be set to 0V.

However, in an actual system, when the impressed voltage is reduced to a certain value, the diaphragm separates from the electrode, because: the electrostatic attraction generated upon the diaphragm contacting the electrode is not infinite because of the existence of the electrode insulating film provided for preventing an electric short circuit upon both electrodes contacting each other; and a repulsive/expansive force occurs after gases existing between electrodes are compressed. According to this mechanism, when the voltage impressed to the diaphragm contacting the electrode is reduced to a certain value, the diaphragm separates from the electrode.

Thereupon, by making actuators 1 and 2 having parameters shown in Table 2 on an experimental basis, maximum voltages capable of biasing the common electrode are investigated. In both actuators, it is assumed that the diaphragm contacts the electrode upon discharging a drop.

TABLE 2

| Parameters of experimental-basis actuators and maximum voltages capable of biasing | | |
|---|---|---|
| | Actuator 1 | Actuator 2 |
| Distance between electrodes (excluding electrode insulating layers) (μm) | 0.5 | 0.2 |
| Material of electrode insulating layers | $SiO_2$ | $SiO_2$ |
| Total thickness of electrode insulating layers (μm) | 0.2 | 0.3 |
| Material of diaphragm | SiN | Si |
| Young's modulus of diaphragm (GPa) | 290 | 170 |
| Shorter-side width of diaphragm (μm) | 90 | 125 |
| Thickness of diaphragm (μm) | 0.9 | 2 |
| Pulse width of impressed voltage (μs) | 6 | 6 |
| Voltage causing diaphragm to contact electrode (V) | 67 | 37 |
| Maximum voltage capable of biasing (V) | 54 | 23 |

As shown in Table 2, the voltage causing the diaphragm to contact the electrode is 67V for the actuator 1, and is 37V for the actuator 2, and the maximum voltage capable of biasing is 54V for the actuator 1 and is 23V for the actuator 2. In the drop discharge head, the driving voltage needs to have a certain range so as to compensate for changes in temperature, variations among the actuators and so forth, or to adapt to a plurality of image-quality modes.

Accordingly, the maximum voltage impressed to the actuator 1 is set to 80V, and the maximum voltage impressed to the actuator 2 is set to 46V. Thereupon, since an optimal bias voltage impressed to the common electrode according to the present invention is approximately half the voltage impressed to the actuator, the bias voltage impressed to the common electrode is 40V for the actuator 1, and the bias voltage impressed to the common electrode is 23V for the actuator 2.

As above, since the maximum voltage capable of biasing is 54V for the actuator 1, the actuator 1 involves no problem. On the other hand, the maximum voltage capable of biasing is 23V for the actuator 2, which is equal to the bias voltage impressed to the common electrode. In consideration of reliability, in the actuator 2, the bias driving method using the direct-current voltage in which the voltage is constantly impressed cannot be selected. However, even in the actuator 2, if the voltage impressed to the common electrode is a pulse-form voltage, the actuator 2 can be used.

Further, when the actuator is driven for a long time, adiabatic expansion and contraction are repeated in the gap between the electrodes so as to induce moisture. This moisture causes a hydrogen bond and a liquid bridging force so as to increase an adsorption force between the contacting electrodes. Therefore, even when the restitution force of the diaphragm is large, driving the actuator for a long time causes a phenomenon in which the diaphragm is stuck to the electrode, if the direct-current bias voltage exists.

Therefore, impressing a pulse-form voltage to the common electrode ensures reliability of the drop discharge head.

Next, a description will be given of polarities of potentials impressed to the common electrode and the individual electrodes.

The above-mentioned level shifter shown in FIG. 11 is a positive voltage conversion level shifter that converts 5V into 12V, for example. On the other hand, the level shifter shown in FIG. 12 is a negative voltage conversion level shifter that converts 5V into −12V, for example. In each of the level shifters, a voltage input from an input terminal Vin is subjected to level-shifting, and is output in-phase from Vout2.

Here, a description will be given of the negative voltage conversion level shifter shown in FIG. 12. When a voltage VH is input to the input terminal Vin, a P-channel MOSFET PMOS2 turns on so that the voltage VH is impressed to a drain of an N-channel MOSFET NMOS2. Besides, an N-channel MOSFET NMOS1 turns on by the voltage VH being impressed to a gate thereof, and impresses a negative voltage VL to a gate of the N-channel MOSFET NMOS2.

Accordingly, as is well known, a withstand pressure required between the gate and the drain of the N-channel MOSFET NMOS2 becomes |VH|+|VL|. This applies similarly to the N-channel MOSFET NMOS1.

That is, when using voltages having the same absolute value, transistors composing the negative voltage conversion level shifter require a larger withstand pressure than transistors composing the positive voltage conversion level shifter.

Besides, in order to increase a reversing speed upon a signal reversal, the P-channel MOSFETs PMOS1 and PMOS2 of the negative voltage conversion level shifter may often need to have a gate width larger than that of the positive voltage conversion level shifter, depending on a manufacturing process to be used. However, since this method increases power consumption during the course of reversal, there is another method using additional transistors for increasing the reversing speed.

As described above, when using voltages having the same absolute value, the negative voltage conversion level shifter becomes larger, i.e., more costly, than the positive voltage conversion level shifter.

Accordingly, when driving an electrostatic head by the head drive control device (adopting the bias method) according to the present invention by using the driving waveform as shown in FIG. 6E which applies positive potentials to numerous individual electrodes and applies a negative potential to only one or several common electrodes, the drive control device can be made inexpensive and small.

Figure 14:
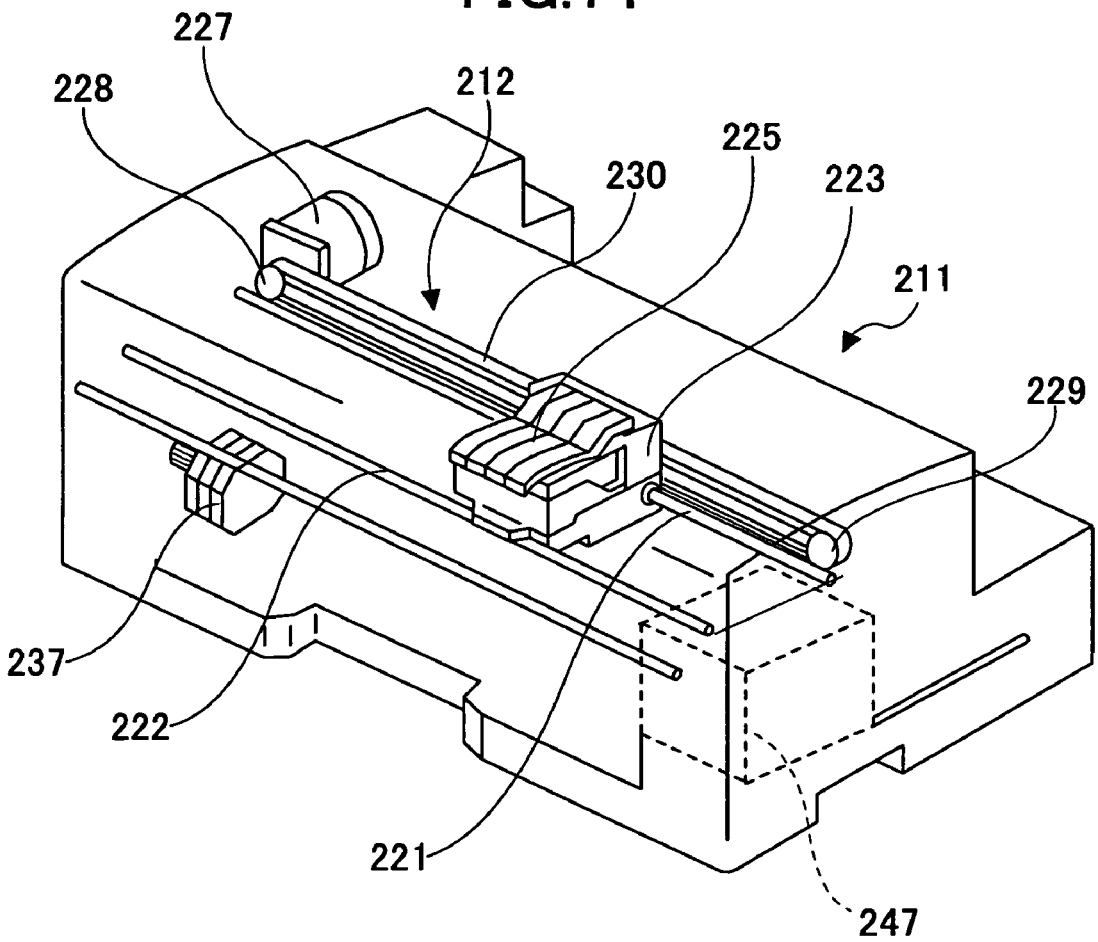
FIG. 14 is a perspective view of a mechanism part of an inkjet recording device according to the present invention.
Figure 15:
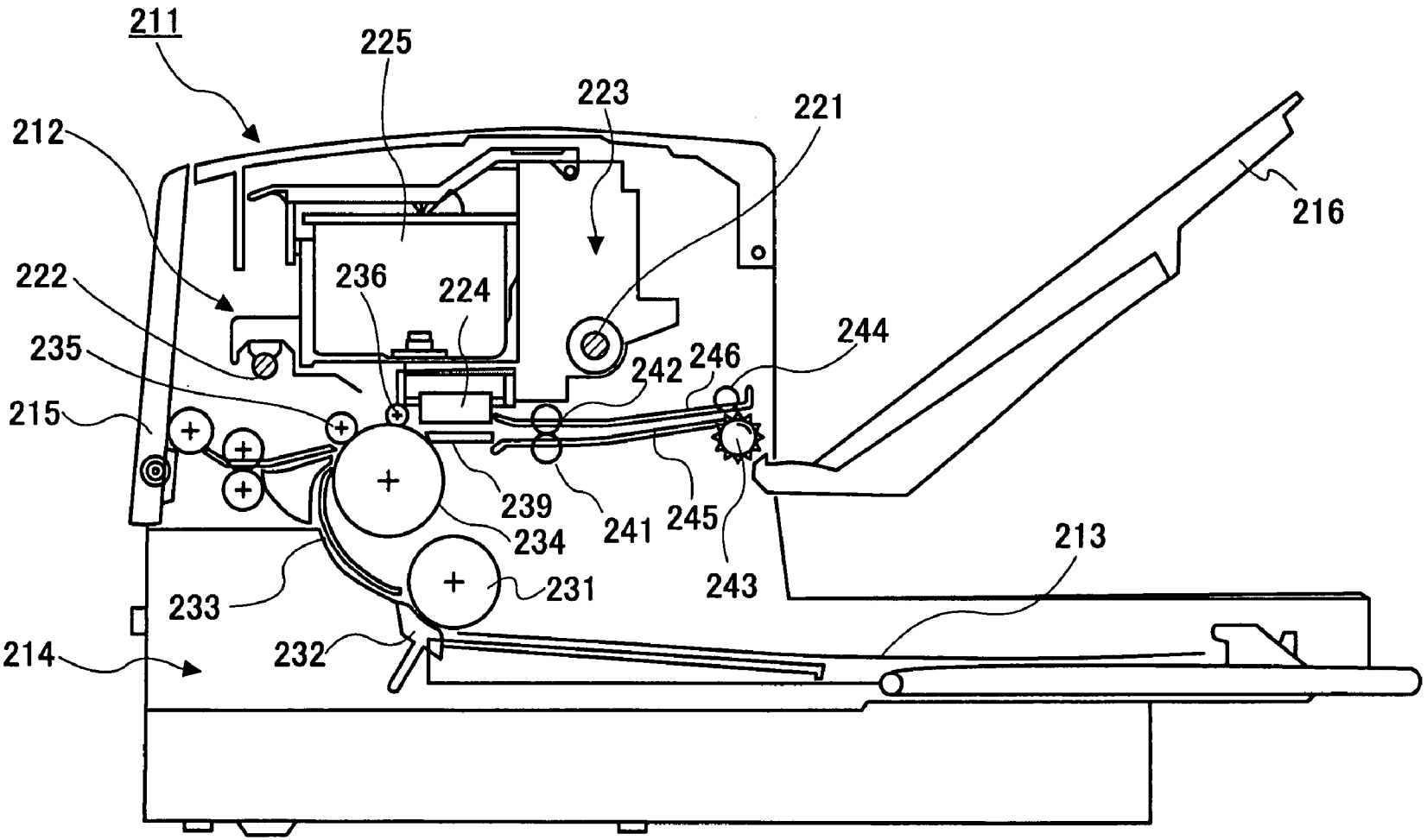
FIG. 15 is a side sectional view of the recording device.

Next, a description will be given, with reference to FIG. 14 and FIG. 15, of an example of an inkjet recording device according to the present invention. FIG. 14 is a perspective view of a mechanism part of the recording device. FIG. 15 is a side sectional view of the recording device.

In this inkjet recording device, a printing mechanism part 212 and so forth are contained in a recording device body 211. The printing mechanism part 212 comprises a carriage 223 movable in a main scanning direction, recording heads 224 composed of the inkjet heads according to the present invention mounted on the carriage 223, ink cartridges 225 supplying inks to the recording heads 224, and so forth. A feeding cassette (or a feeding tray) 214 capable of carrying multiple sheets 213 can be inserted detachably from a front side in a lower part of the body 211. Besides, a manual feeding tray 215 can be opened for manually feeding the sheets 213. The sheet 213 fed from the feeding cassette 214 or from the manual feeding tray 215 is taken into the recording device, and a desired image is recorded by the printing mechanism part 212. Thereafter, the sheet 213 is delivered to a delivery tray 216 attached at a rear side.

The printing mechanism part 212 holds the carriage 223 slidably by a main guide rod 221 and a sub guide rod 222 which are guide members provided horizontally across right and left side boards not shown in the figures so that the carriage 223 is capable of sliding freely in the main scanning direction (a direction perpendicular to a surface of FIG. 15). The heads 224 composed of the electrostatic inkjet heads discharging ink drops of colors of yellow (Y), cyan (C), magenta (M) and black (Bk) are mounted on the carriage 223 so that a plurality of ink discharge openings are arranged in a direction crossing the main scanning direction, and that a direction of discharging the ink drops faces downward. The ink cartridges 225 for supplying the inks of the respective colors to the heads 224 are also mounted replaceably on the carriage 223.

Each of the ink cartridges 225 includes an air opening at an upper part, a supply opening at a lower part, and a porous member in an inner part. The air opening communicates with air. The supply opening supplies the ink to the inkjet head. The porous member is filled with the ink inside. The ink supplied to the inkjet head is maintained at a slight negative pressure by a capillary force of the porous member.

Besides, although the heads 224 of the respective colors are used as recording heads in the present embodiment, one head including nozzles discharging the ink drops of the respective colors may be used instead.

The main guide rod 221 is inserted into the carriage 223 slidably at the rear side (downstream in a sheet conveyance direction of conveying the sheets). The carriage 223 is put on the sub guide rod 222 slidably at the front side (upstream in the sheet conveyance direction). Besides, in order to move the carriage 223 in the main scanning direction, a timing belt 230 is stretched between a driving pulley 228 and a driven pulley 229 rotated by a main scanning motor 227. The timing belt 230 is fixed to the carriage 223, and the carriage 223 is driven back and forth by forward and backward rotations of the main scanning motor 227.

On the other hand, in order to convey the sheet 213 set in the feeding cassette 214 to beneath the heads 224, a feeding roller 231, a friction pad 232, a guide member 233, a conveying roller 234, a conveyance roller 235, and a leading-edge roller 236 are provided. The feeding roller 231 and the friction pad 232 separate and feed the sheet 213 from the feeding cassette 214. The guide member 233 guides the sheet 213. The conveying roller 234 reverses and conveys the fed sheet 213. The conveyance roller 235 is pressed against a circumference of the conveying roller 234. The leading-edge roller 236 regulates an angle at which the sheet 213 is sent out from the conveying roller 234. The conveying roller 234 is rotationally driven by a sub-scanning motor 237 via a series of gears.

In addition, a print receptacle member 239 is provided. The print receptacle member 239 is a sheet guide member guiding the sheet 213 sent out from the conveying roller 234 beneath the recording heads 224 in accordance with a moving range of the carriage 223 in the main scanning direction. A conveyance roller 241 and a spur 242 are provided downstream from the print receptacle member 239 in the sheet conveyance direction. The conveyance roller 241 and the spur 242 are rotationally driven so as to send out the sheet 213 in a delivery direction. Further, a delivery roller 243, a spur 244, and guide members 245 and 246 are provided. The delivery roller 243 and the spur 244 send out the sheet 213 to the delivery tray 216. The guide members 245 and 246 form a delivery path.

Upon a recording operation, the recording heads 224 are driven according to an image signal while moving the carriage 223 so as to record one line by discharging the inks to the halted sheet 213, and record a next line after conveying the sheet 213 by a predetermined distance. Upon receiving an end-of-recording signal or a signal indicating an arrival of a trailing end of the sheet 213 at a recording area beneath the recording heads 224, the recording operation is ended and the sheet 213 is delivered.

Besides, a recovery device 247 for recovering a discharge fault of the heads 224 is provided at a position rightward in the moving direction of the carriage 223 outside the recording area. The recovery device 247 includes a capping part, a sucking part, and a cleaning part. During a standby for printing, the carriage 223 is moved to the recovery device 247, and the heads 224 are capped by the capping part so as to keep the discharge openings in a wet state, thereby preventing a discharge fault originating from a drying of the ink. Besides, inks irrelevant of recording are discharged during the recording, etc., so as to make viscosity of the inks at all of the discharge openings constant, thereby maintaining a stable discharge performance.

In cases, such as that a discharge fault occurs, the discharge openings (the nozzles) of the heads 224 are sealed hermetically by the capping part, and air bubbles and so forth as well as the inks are sucked out of the discharge openings by the sucking part via tubes; inks, dusts and so forth adhering to surfaces of the discharge openings are removed by the cleaning part, thereby recovering the discharge fault. Besides, the sucked inks are ejected to a waste ink holder (not shown in the figures) provided in the lower part of the body 211, and are absorbed in an ink absorber in the waste ink holder.

In the heretofore-described inkjet recording device, the inkjet heads composing the recording heads 224 are driven by the head drive control device according to the present invention. Thus, the recording heads 224 can be formed by the inkjet heads having a high degree of nozzle concentration at a low cost, thereby obtaining the inexpensive inkjet recording device capable of recording with a high image quality.

Besides, the above-described embodiment is an example in which the diaphragms form the common electrode, and the opposing electrodes as the second electrodes form the individual electrodes, since the diaphragms are unitarily formed throughout the actuators so that the diaphragms forming the first electrodes are combined electrically throughout the actuators. However, as mentioned above, the opposing electrodes as the second electrodes may be combined electrically throughout the actuators so as to form the common electrode, and the diaphragms may be separated for each of the actuators so as to form the individual electrodes.

Additionally, the common electrode may be formed by the first electrodes or the second electrodes combined electrically throughout all of the actuators, as mentioned above; alternatively, all of the actuators may be divided into a plurality of blocks, and a plurality of common electrodes may be formed for the blocks (a number of the common electrodes being smaller than a total number of the actuators)

Further, the inkjet head is explained above as an example of the drop discharge head driven and controlled by the head drive control device according to the present invention. However, the head drive control device according to the present invention is also applicable for driving and controlling a drop discharge head discharging a drop of liquids other than ink, such as a liquid resist used for patterning, or a gene analysis sample.

The present invention is not limited to the specifically disclosed embodiments, and variations and modifications may be made without departing from the scope of the present invention.

The present application is based on Japanese priority application No. 2002-272383 filed on Sep. 19, 2002, the entire contents of which are hereby incorporated by reference.

The invention claimed is:

1. A liquid-discharge head including an electrostatic actuator which includes a nozzle discharging a liquid drop, a discharge room communicating with the nozzle, a diaphragm having a first electrode forming a wall surface of the discharge room, and a second electrode opposing the first electrode, the diaphragm being deformed by generating an electrostatic force between the first electrode and the second electrode, wherein the liquid-discharge head comprises:

a first separate electrode provided in a vicinity of the first electrode which contacts a portion of the second electrode when the diaphragm is deformed, the first separate electrode being electrically isolated from the first electrode; and a second separate electrode provided in a vicinity of the second electrode which contacts a portion of the first electrode when the diaphragm is deformed, the second separate electrode being electrically isolated from the second electrode.

2. The liquid-discharge head according to claim 1, wherein the first separate electrode and the second separate electrode are electrically connected to each other.

3. The liquid-discharge head according to claim 2, wherein the first separate electrode and the second separate electrode are connected to a ground terminal.

4. A recording device which discharges a liquid drop from the liquid-discharge head according to claim 1, wherein the liquid-discharge head includes a plurality of electrostatic actuators, and the first electrodes of the electrostatic actuators are combined electrically, wherein the liquid-discharge head comprises a part applying differently polarized potentials to the first electrode and the second electrode upon discharging a liquid drop.

5. The recording device according to claim 4, wherein said part applies a positively polarized potential to the second electrode.

6. The recording device according to claim 4, wherein maximum values of the different polarized potentials applied to the first electrode and the second electrode have substantially equal absolute values.

7. The recording device according to claim 4, wherein waveforms of the differently polarized potentials applied to the first electrode and the second electrode are pulse waveforms.

8. A recording device which discharges a liquid drop from the liquid-discharge head according to claim 1, wherein the liquid-discharge head includes a plurality of electrostatic actuators, and the second electrodes of the electrostatic actuators are combined electrically, wherein the liquid-discharge head comprises a part applying differently polarized potentials to the first electrode and the second electrode upon discharging a liquid drop.

9. The recording device according to claim 8, wherein said part applies a positively polarized potential to the first electrode.

10. An image forming device which records an image by discharging a liquid drop, wherein the image forming device comprises the liquid-discharge head according to claim 1.

* * * * *